US008727825B2

(12) United States Patent
Tsolkas

(10) Patent No.: US 8,727,825 B2
(45) Date of Patent: May 20, 2014

(54) LIFE JACKET

(76) Inventor: Alexander Tsolkas, Riedstadt (DE)

( * ) Notice: Subject to any disclaimer, the term of this patent is extended or adjusted under 35 U.S.C. 154(b) by 0 days.

(21) Appl. No.: 13/513,262

(22) PCT Filed: Dec. 3, 2010

(86) PCT No.: PCT/DE2010/001396

§ 371 (c)(1),
(2), (4) Date: Jun. 4, 2012

(87) PCT Pub. No.: WO2011/066820

PCT Pub. Date: Jun. 9, 2011

(65) Prior Publication Data

US 2012/0244766 A1 Sep. 27, 2012

(30) Foreign Application Priority Data

Dec. 4, 2009 (DE) ..... 10 2009 056 744

(51) Int. Cl.
*B63C 9/08* (2006.01)

(52) U.S. Cl.
USPC ..... 441/89; 441/92

(58) Field of Classification Search
USPC ..... 441/89
See application file for complete search history.

(56) References Cited

U.S. PATENT DOCUMENTS

| | | | | |
|---|---|---|---|---|
| 2,429,973 | A | 11/1947 | Alexander | |
| 2,648,325 | A | 8/1953 | Siple | |
| 4,416,641 | A | 11/1983 | Spinosa et al. | |
| 5,603,648 | A | 2/1997 | Kea | |
| 5,960,469 | A | 10/1999 | Nuckols et al. | |
| 6,278,092 | B1 | 8/2001 | Wu | |
| 6,837,182 | B2 * | 1/2005 | Leblanc | 119/220 |
| 7,412,944 | B2 * | 8/2008 | Wescombe-Down | 119/220 |

(Continued)

FOREIGN PATENT DOCUMENTS

| | | |
|---|---|---|
| AT | 40 400 | 1/1910 |
| AT | 004 722 | 11/2001 |

(Continued)

OTHER PUBLICATIONS

International Search Report of PCT/DE2010/001396, Mar. 22, 2011.

(Continued)

*Primary Examiner* — Lars A Olson
*Assistant Examiner* — Jovon Hayes
(74) *Attorney, Agent, or Firm* — Collard & Roe, P.C.

(57) ABSTRACT

A life jacket for aquatic use with a back part 1*a* and plurality of front parts 1*b*, which can be connected with each other by means of a fastener, wherein the life jacket 1 is built of a plurality of layers, is intended to improve the survival potential of its carrier in an emergency situation specifically in cold waters. Therefore it is proposed according to the invention that at or near at the interior side a layer 16 is provided, which includes a latent-heat storage material, in which an exothermic reaction takes place upon activation by a provided activation unit 20,21. The layer 16 containing the latent-heat storage material is subdivided into a plurality of chambers 24 in the back part 1*a* and in the front parts 1*b*, which are connected directly with each other or are connected to one another via connecting channels. Further the life jacket 1 has short arms 22, which cover the shoulders and extend into the upper arm area. Layer 16 continues into the shoulder area and upper arm area.

15 Claims, 5 Drawing Sheets

(56) References Cited

U.S. PATENT DOCUMENTS

Figure 1:
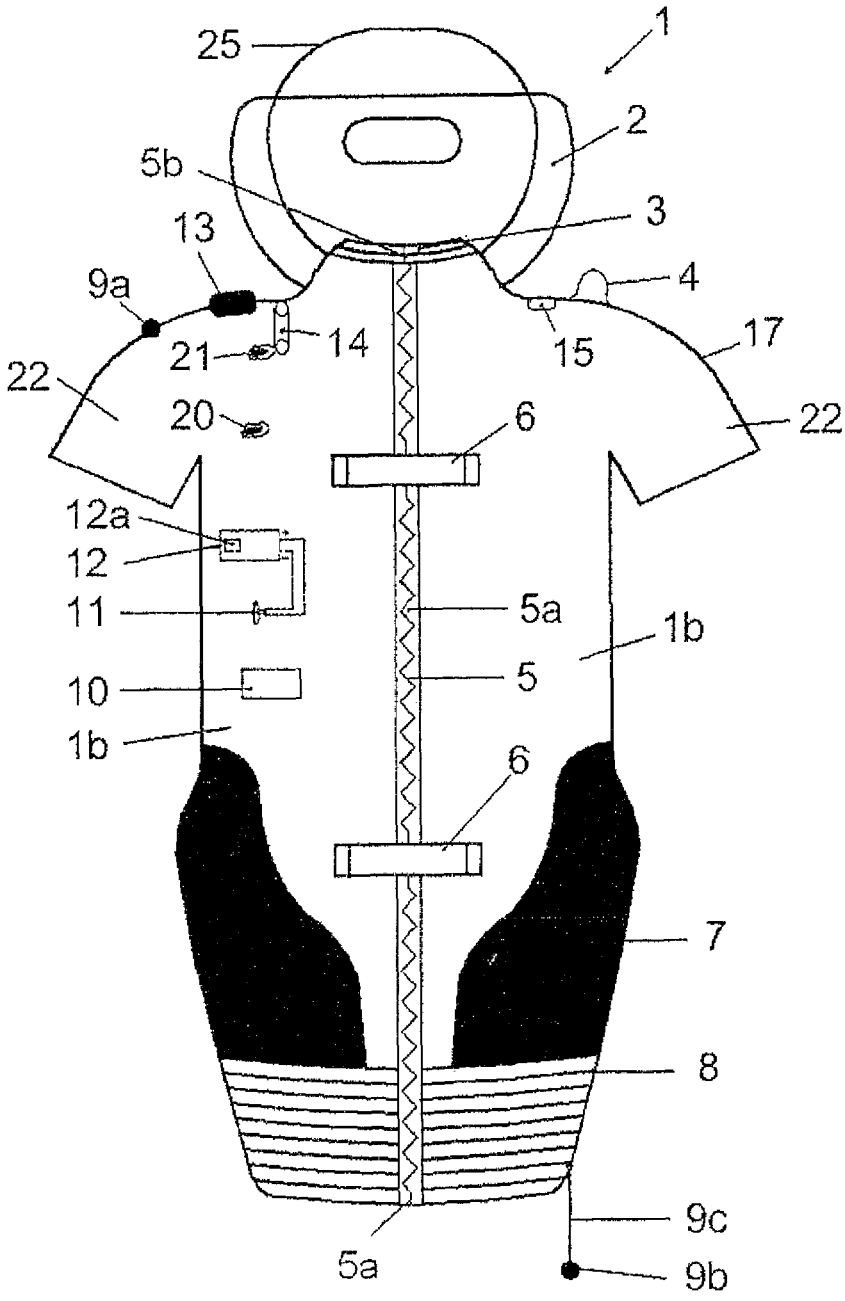

| | | | | |
|---|---|---|---|---|
| 7,900,573 | B2 * | 3/2011 | Prendergast et al. | 114/336 |
| 8,004,461 | B2 | 8/2011 | Kim | |
| 2005/0071905 | A1 | 4/2005 | Polak et al. | |
| 2005/0106962 | A1 | 5/2005 | Johnson | |
| 2010/0015867 | A1 * | 1/2010 | Betz et al. | 441/92 |
| 2010/0271187 | A1 * | 10/2010 | Uysal et al. | 340/10.4 |
| 2011/0294382 | A1 * | 12/2011 | Puls et al. | 441/89 |
| 2012/0122358 | A1 * | 5/2012 | Hansbro | 441/89 |

FOREIGN PATENT DOCUMENTS

| | | | |
|---|---|---|---|
| CN | 1564767 | A | 1/2005 |
| CN | 101341661 | A | 1/2009 |
| DE | 1 911 004 | | 3/1965 |
| DE | 15 14 185 | | 5/1969 |
| DE | 28 29 427 | | 1/1980 |
| DE | 29 41 116 | | 4/1981 |
| DE | 38 18 123 | | 12/1989 |
| DE | 93 02 050 | | 7/1993 |
| DE | 94 04 655 | | 7/1994 |
| DE | 198 13 562 | | 11/1998 |
| DE | 299 22 947 | | 5/2000 |
| DE | 203 02 777 | | 6/2003 |
| EP | 0 101 256 | | 2/1984 |
| RU | 1827518 | C | 7/1993 |
| RU | 2201601 | C2 | 3/2003 |
| RU | 49319 | U1 | 11/2005 |
| WO | 2003/031257 | A1 | 4/2003 |
| WO | WO 03/075692 | | 9/2003 |
| WO | WO 2006/125910 | | 11/2006 |
| WO | WO 2008/054847 | | 5/2008 |

OTHER PUBLICATIONS

International Preliminary Report on Patentability of PCT/DE2010/001396 and Written Opinion of the International Searching Authority dated Jun. 5, 2012.

* cited by examiner

LIFE JACKET

CROSS REFERENCE TO RELATED APPLICATIONS

This application is the National Stage of PCT/DE2010/001396 filed on Dec. 3, 2010, which claims priority under 35 U.S.C. §119 of German Application No. 10 2009 056 744.5 filed on Dec. 4, 2009, the disclosure of which is incorporated by reference. The international application under PCT article 21(2) was not published in English.

The invention refers to a life jacket for aquatic use with a back part and a plurality of front parts which can be connected to one another by means of a fastener, wherein the life jacket is formed by a plurality of layers.

A life jacket for aquatic use—also called life vest—is an article of clothing, which can turn a person in water automatically into a dorsal position and keep the head over water, to keep the respiratory tracts free. The term "aquatic use" is not restricted for use on open waters in the oceans and tasks like shipping, sailing, drilling platforms etc., but also the use for activities on stagnant or flowing sweet waters.

Life jackets can differ in two major types. There are solid matter life jackets on the one hand, which are filled with a solid, swimmable material, which does not absorb water (i.e. Polystyrene, cork etc.). On the other hand there are inflatable life jackets, which are equipped with inflatable floating bodies. Such life jackets are equipped with a gas pressure cartridge, which do activate the life jacket automatically (generally due to a contact of a sensor (i.e. salt tablet) with water) or manually in an emergency situation, whereby the life jacket will be inflated within seconds.—Life jackets of the referred types are commonly known and in use, so that it is unnecessary to provide the evidence in written form. Generally they provide a back part and a plurality of front parts which can be connected to one another by means of a fastener. Vertically the front parts can be closed by means of a vertical closing mechanism (i.e. zip lock or hook-and-loop fastener). Alternatively or additionally at minimum one horizontal closing mechanism (i.e. a locking belt, locking tape) can be provided. A life jacket consists of multiple layers, i.e. external layer, functional layer (swimmable material or inflatable layer), internal layer. Further jacket complementary protection cloths are known, which include lifting bodies or aerial lifting bodies, which are used as weather jackets with life vest function (i.e. DE 1 911 004 U). In WO 03075692 A1 a short arm shirt for water sport is described, in which a hidden inflatable air chamber is placed, so that this garment serves as a lifting aid in an emergency situation.

In an emergency situation which means, that if a person is inadvertently located in water after an accident or disaster, a life jacket reduces the amount of required power for swimming movements and keeps unconscious or weak persons above the water surface. This extends the time, to which exhaustion takes place, so that more time will be available for rescue. It is more a problem if the emergency situation takes place in cooler or ice cold water with temperatures under 29 degrees Celsius, because hypothermia of a body can take place in a short period of time. As known, a lot of castaways die from hypothermia worldwide. In 4 to 10 degrees Celsius cold water, the time where exhaustion or unconsciousness of a man commence, takes 30 to 60 minutes and the estimated survival time in this case is one to three hours.

An object of the invention is to provide a low maintenance life jacket, which improves the survival potential of its carrier in an emergency situation in especially cold waters.

This object is achieved by a life jacket with the characteristics of claim 1.

Corresponding to the invention, the life jacket has at or close to the interior side of the life jacket a layer, which includes a latent-heat storage material, which causes an exothermic reaction upon activation. Upon activation of the latent-heat storage material the layer produces heat which will be released to the carrier of the life jacket. By releasing the heat towards the body, the time period at which hypothermic exhaustion and death will occur, will be extended, so that more time will be available for third parties, to search and rescue the person in the emergency situation.

Latent-heat storage materials are such materials, which can store thermal energy hidden, low-loss, with multiple repeating cycles over long time. Such materials are known (i.e. EP 0 101 256 B1, DE 198 13 562 A1) and are in use of regenerating pocket warmers, hand warmers, hot plates etc. The enthalpy of reversible thermodynamic changes of state of the storage medium is used, especially the phase transformation solid-liquid. The storage medium absorbs thermal energy during the change of the aggregate state (solid-liquid) at constant temperature (so called storage temperature) or releases it again. According to the system in use a special salt or an organic compound (i.e. Paraffine) is melted. The stored thermal energy (melting heat) is released during the solidification of the storage medium. In the scope of the invention, suitable systems are designed in a way that the melt of the latent-heat carrier medium even under the melting temperature is liquid in a meta-stable condition (meta-stable system) and the solidification is taking place after a targeted activation from the outside. The activation takes place by a provided activation unit.

The suggested application of a latent-heat storage material in the scope of the invention has multiple advantages in comparison to known life jackets with active addition of heat to the body:

From DE 299 22 947 U1 a life jacket is known, which uses multiple ceramic PTC resistors, an anode structure as well as a cathode structure, whereby PTC resistors are supplied via a battery with electric power and heat the life jacket locally. The life jacket according to the invention on the opposite does not need electric power for producing heat in case of an emergency situation, so that a battery provided in the life vest can be smaller in dimensions, or their energy can be used for other purposes (i.e. for supplying a signal light at the life vest) for a longer time. Further, the life vest according to the invention requires a lower maintenance effort, because batteries or other accumulators get old and lose charge and the electrical contacts of the PTC resistors are sensitive to mechanical stress.

Further, rescue cloths are known, in which chemical components are contained, which react exothermic with each other after activation and release heat to the carrier of the cloth. In DE 29 41 116 A1 a rescue jacket is described, at which interior side packages, pads, caps, inlays, fillings or similar are provided, which contain separated substances, which produce heat after mixing them together. U.S. Pat. No. 5,603,648 A shows a life vest with a layer inside, in which heat is produced, if two dilutions which can be mixed react with each other. In U.S. Pat. No. 2,429,973 A the life vest contains multiple heating units in its lower area, which contain a solid matter mixture, which reacts exothermic when getting in contact with water. In difference to the possibilities for producing heat known from the state of art, the latent-heat storage material of the life jacket according to the invention can be used multiple times, because it can be melted again after an activation and solidification by the addition of heat.

Further, the heat in the storage material is stored consistently. Upon activation a continuing solidification process starts, whereby heat will be produced and released continually and consistently, whereas the known solutions have as a prerequisite for a heat production in an emergency situation the good continuous mixing of the mixable substances, which represent a maintenance intensive activation mechanism.

Important for the selection of an adequate latent-heat storage medium for a life jacket is the temperature, which can be reached in the material after activation, thus the specific storage temperature. It should reach at minimum human body temperature for protection against hypothermia. However, the chosen storage temperature should not be too high because otherwise there is the risk of burnings during carrying the life jacket. The storage temperature of the latent-heat storage material should reach preferably between 50 and 70 degrees Celsius. For the scope of the invention a preferable latent-heat storage medium for usage is Natrium Acetate Trihydate or another salt hydrate. Also systems with a Magnesium Lithium Nitrate mixture or with Aluminium Nitrate can be used advantageously.

The layer containing the latent-heat storage material is in the back part and in the front parts of the life jacket partitioned in a plurality of chambers. This supports a better distribution of the storage material and a more continuous heating supply for the body to be protected. In order that the heating release takes place after the activation of the latent-heat storage material in all chambers, it is expedient, if the chambers are connected to each other. For example central connecting channels can be provided, via which the chambers are interconnected. It is important, that after the end of the heating process and the solidification of the latent-heat storage material, an adequate freedom of movement for the carrier of the life vest is maintained. Preferably this can be reached by size, design and arrangement of the single chambers. Further it might be advantageously to enclose the latent-heat storage material with a flexible covering, i.e. elastic foil or similar. Advantageously elastic inserts between the chambers can be provided. Also the use of a flexible latent-heat storage material, meaning a medium, which is still flexible after solidification, is possible.

The invention provides that the life jacket has short arms, which cover the shoulders and at least parts of the upper arms. Thus a getting out of place of the life jacket during carriage will be avoided and the fitting is enhanced. Because of—in comparison to a life jacket without arms—the reduced cross-sectional area of the opening at the short arms, the inward flow of cold water to the trunk of the life vest carrier will be reduced. The upper trunk of the life vest carrier will be better protected against cooling. The latent-heat storage layer continues into the shoulder areas and upper arm areas, to heat the body at these places too, in an emergency situation.

According to an advantageous development of the invention the life jacket is an inflatable life jacket. Such a vest offers a higher wearing comfort, because it is small or thin in a non-inflated condition, and therefore the freedom of movement of the carrier is less reduced. Furthermore, the gas layer works as an additional isolation layer, that is to say, that it reduces the heat release to the environment. Additionally, the gas layer presses the life jacket in an emergency situation to the trunk of the vest carrier. By this means, the water circulation around the body will be reduced, which leads to a reduction of the thermal loss of the body and to a reduction of the loss of the heat produced by the latent-heat storage material.

Advantageously, tight fitting and/or adjustable arm cuffs, wristbands or similar can be provided at the lower border area of the short arms. By this means, the water circulation around the body will be reduced and thereby the thermal loss of the body and the loss of the heat produced by the latent-heat storage material can be reduced.

To reduce the water circulation even more, advantageously at least one arm air chamber is provided at each short arm in the region of the arm cuffs, which is arranged and designed in such a manner that during the inflation of the life jacket a contact pressure is generated in the arm air chamber acting on the respective arm cuff. By the means of the clever distribution of the inflation air, an additional waterproofing at the arm cuff area will be reached.

To reach a waterproofing as well at the upper area of the life jacket, the vest advantageously has a fitting polo neck, a fitting neck cuff or similar in the neck area, which is preferably built of Neoprene material. Instead of Neoprene, Cloroprene-Caoutchouc material, Polychloroprene-material or similar can be used.

To reduce the entering of water from the lower border area of the vest into the internal between vest and body and thus to reduce the thermal loss, it is further suggested, that the life jacket in its advantageous development, has a water-repellent, tight fitting and/or adjustable pelvis cuff at the lower border areas of the front parts and the back part. This serves for waterproofing of the lower border area of the vest during carriage.

A preferred design of the invention provides that the front parts of the life jacket are connectable with each other in vertical direction by a waterproof or water repellent closure. This can be a zip lock or a hook-and-loop fastener for example. By this means the entering of water via the front parts into the interior between vest and body, and thus the thermal loss will be reduced.

In a preferred embodiment the life jacket comprises an activation unit for the latent-heat storage material, which will be automatically operated during inflation of the life jacket (automatic activation unit). By this means there is no additional sensor for the activation of the latent-heat storage material necessary, which must monitor, if an emergency situation (meaning the carrier is located in water and that it is not because of, contact with just splashing water) is existent. An automatic activation has an advantage over a pure manual controlled activation, that it will protect its carrier in an emergency situation against hypothermia, even if he has lost his consciousness during the underlying accident or similar.—Alternatively the vest can contain an additional sensor, which monitors, if there is an emergency situation and which can activate directly the latent-heat storage material.

According to an advantageous design the activation unit is a small metal plate or similar, which is located in the area of the latent heat storage material, and which receives a movement during inflation of the life jacket. This means that during inflation of the life jacket the small metal plate is relaxed or that it will be buckled.

It can be an advantage, if the chambers in the front parts and/or in the back part are designed in ribs and are running across or diagonal to the body. This provides that person in the emergency situation will have a better freedom of movement, especially, if the storage material performs a solidification during the exothermic reaction and thus will become unflexible. The arrangement of the chambers e.g. can generally match the direction of the ribs of the human body in the thorax.

According to an advantageous embodiment of the invention the interior side of the life jacket in direction to the carrier of the vest is made of Neoprene. The Neoprene layer serves due to the characteristics of the material of Neoprene as a thermal storage of the heat produced by the latent-heat storage material, so that loss of heat in water will be reduced. Further it will be avoided, that the produced heat will be released directly to the body and therefore serves against burnings when having direct contact with the skin or when the carrier wears thin cloths. Instead of Neoprene, Cloroprene-Caoutchouc material, Polychloroprene-material or similar materials can be used.

Figure 2:
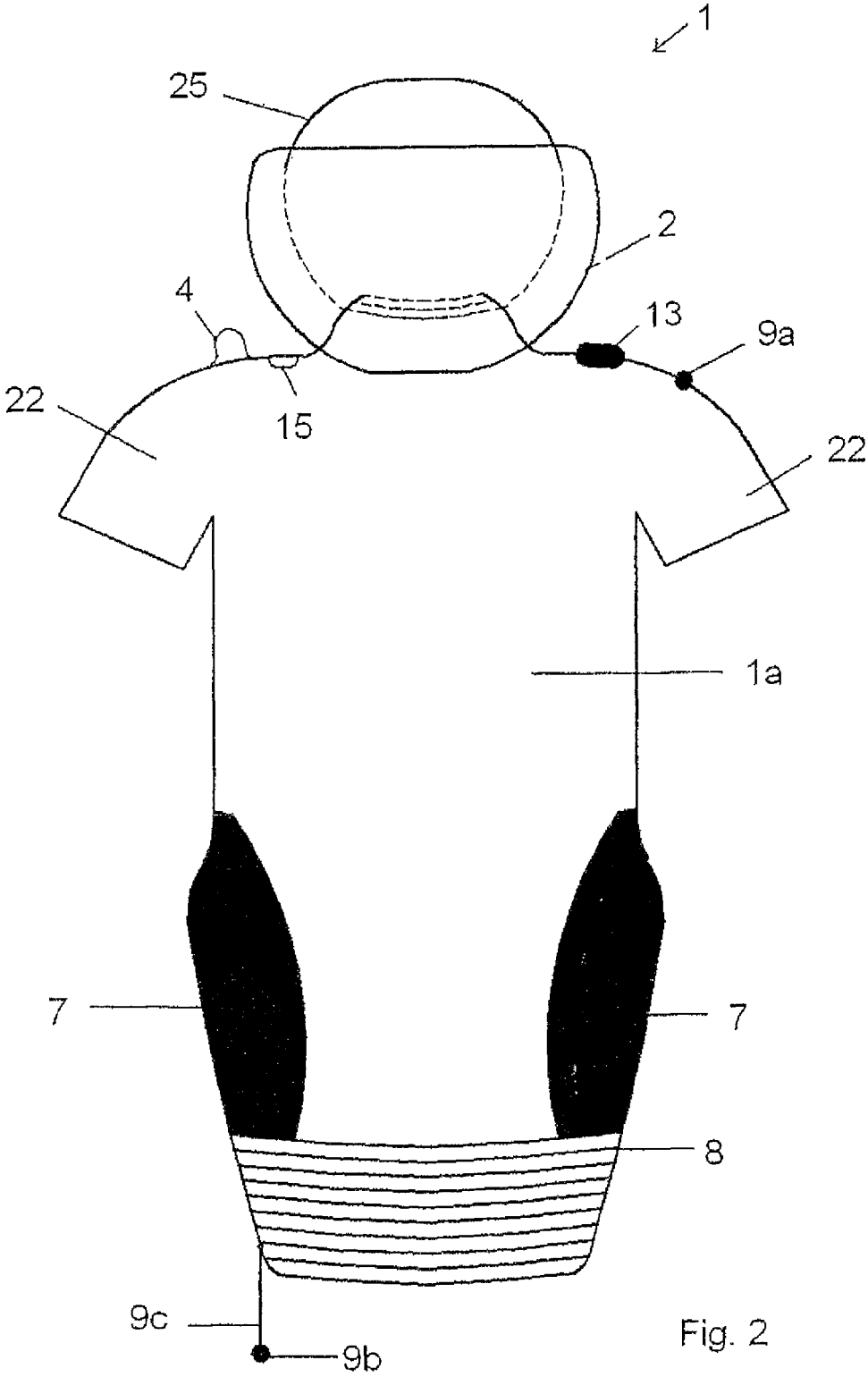
Figure 3A:
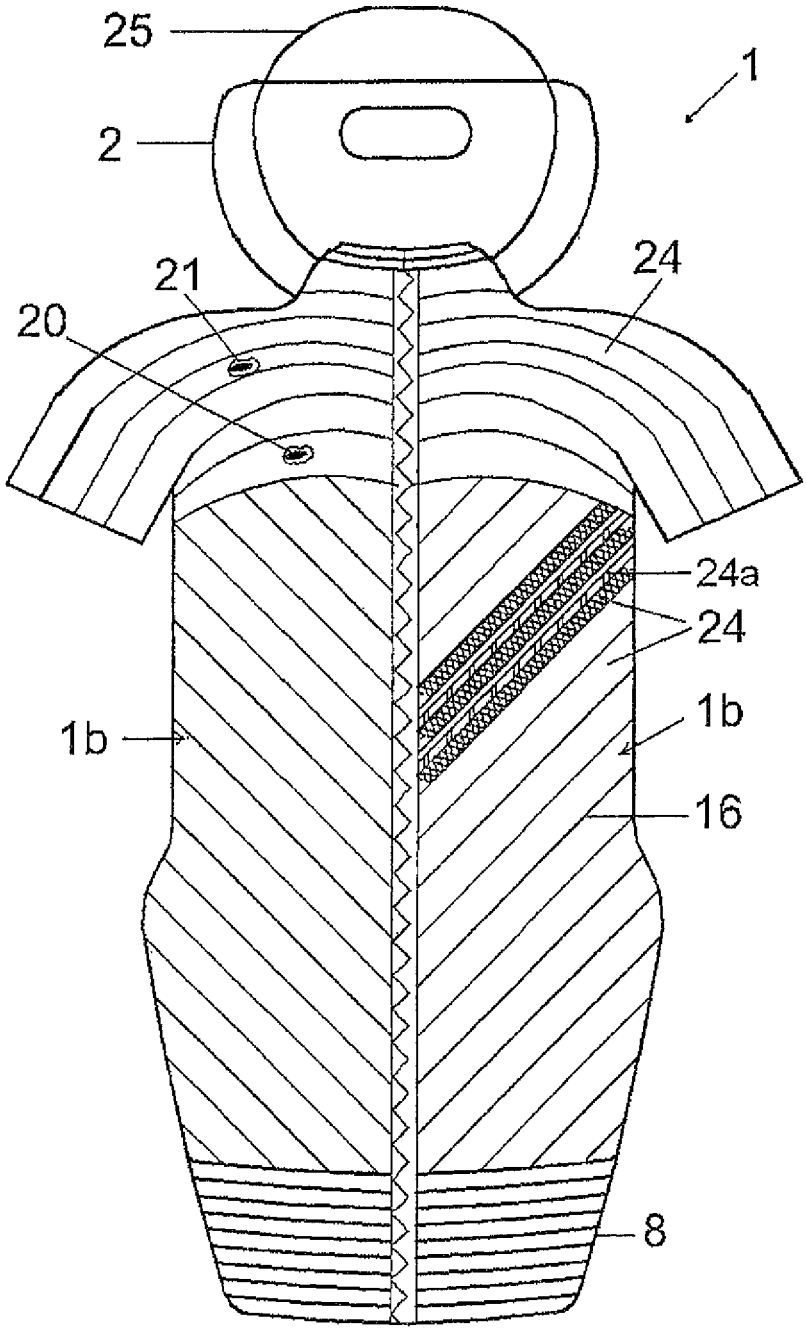
Figure 3B:
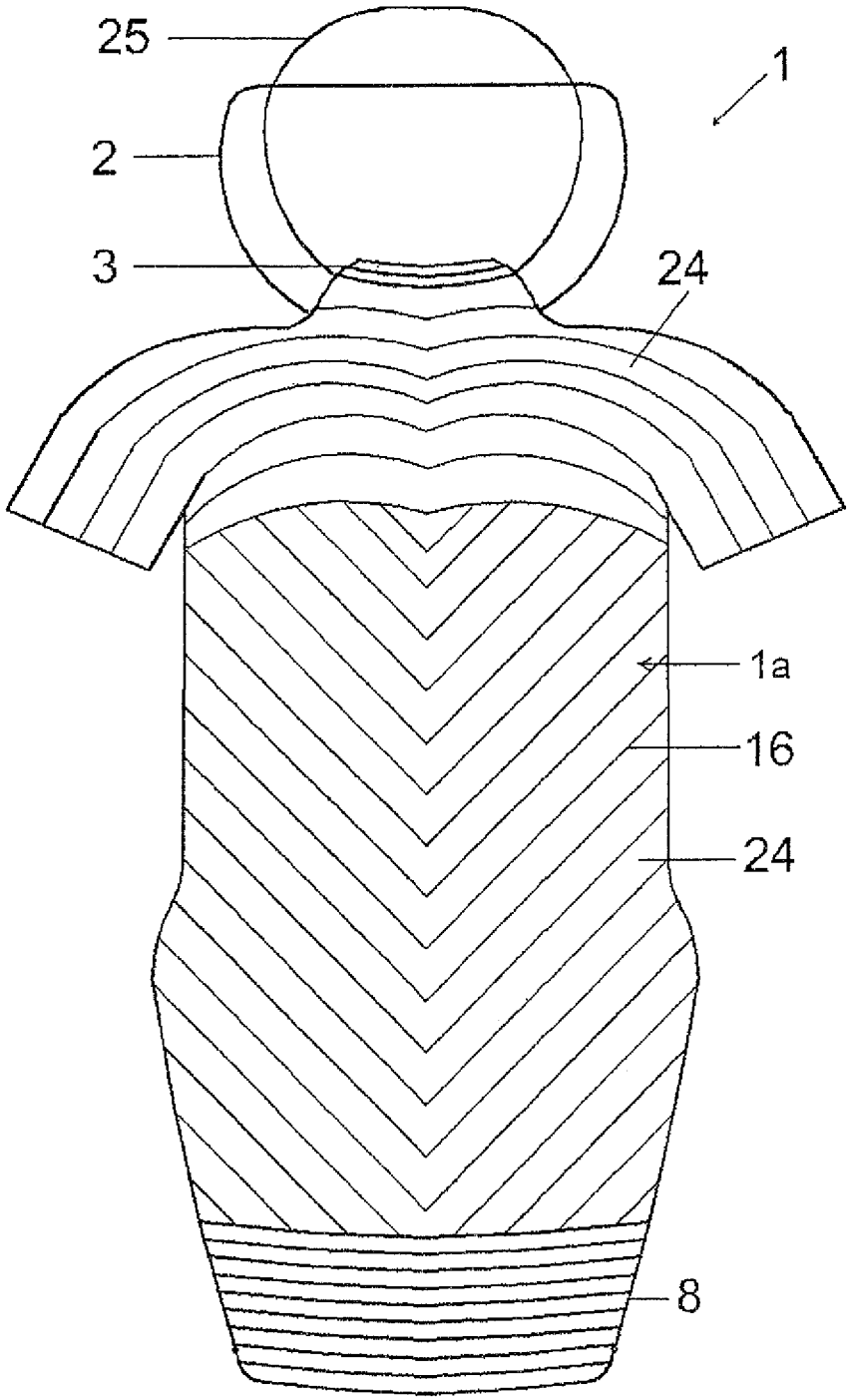
Figure 4:
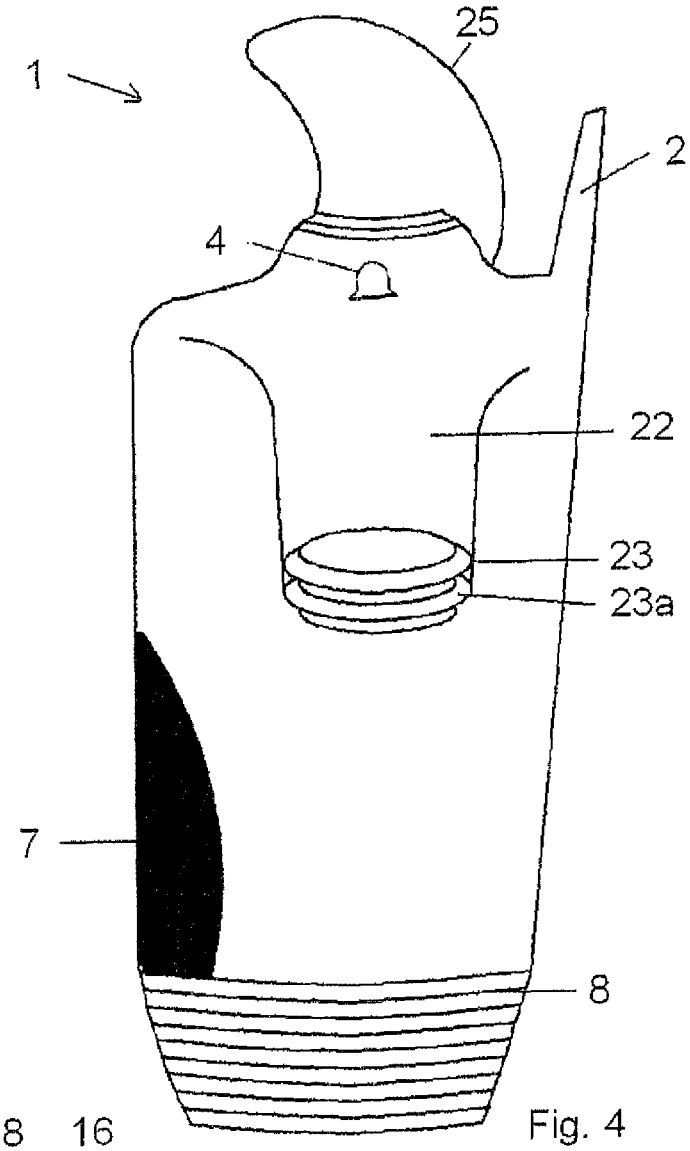
Figure 5:
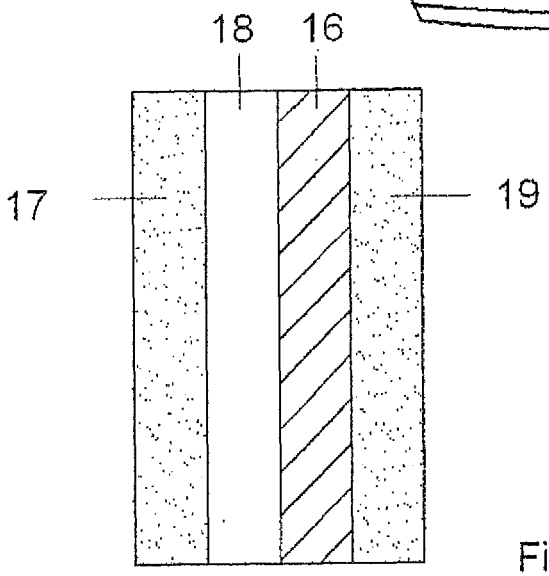

In the drawings schematic embodiments of the life jacket according to the invention are shown. It shows:

FIG. 1 a life jacket according to the invention in a front view,

FIG. 2 the life jacket according to FIG. 1 in a dorsal view,

FIG. 3*a* an advantageous arrangement of the latent-heat storage material of a life jacket in a front view, FIG. 3*b* an advantageous arrangement of the latent-heat storage material of the life jacket in a dorsal view, FIG. 4 a side view of a life jacket and FIG. 5 schematic view of the layer structure of the life jacket.

The life jacket displayed in FIGS. 1 to 4 for aquatic use has a back part 1*a*, which extends during carriage of the life vest 1 in the back area, and a plurality of (here two) front parts 1*b* which are to be connected by means of a fastener with each other, which are located at the chest area during the carriage of the life jacket (see FIGS. 1 and 2), wherein it is constructed of a plurality of layers. For such a life jacket 1 it is important, that it contains at or near at the interior side a layer 16, which contains a latent-heat storage material, which causes an exothermic reaction upon activation (see FIGS. 3*a* and 3*b*). This heat producing layer 16 has not to cover the whole life jacket 1. It is important, that in an emergency situation, the sensitive, thermo critical upper trunk of the human will be protected against hypothermia, so that an arrangement of the heat producing layer 16 will be necessary at least in this area. Advantageously it covers all of the trunk. After initiating the exothermic reaction in the latent-heat storage material, a temperature, which is higher than the human body temperature, at the beginning advantageously 50 to 70 degrees Celsius, will be produced over a longer period of time, preferably multiple hours.

Besides a passive protection against cooling out (isolation effect of the life jacket due to the selected materials) the life jacket 1 according to the invention has additionally an active protection against cooling out by actively producing heat out of the life jacket 1 which will be released towards the body. The life jacket 1 works against the cooling out of its carrier for the time period of the heat release.

Besides the heat producing layer 16 with latent-heat storage material, the life jacket 1 shown in the figures provides additional characteristics, which serve, to extend the life time of a person in an emergency situation in cold waters. In FIGS. 1 and 2 it can be seen, that the life jacket is equipped with short arms 22, which cover shoulders and areas of the upper arms. By the use of this "T-Shirt"-cut not only the fitting of the life jacket 1 will be enhanced, but also the covered body parts will be protected against cold and thermal loss. Further, the heat producing layer 16 extends towards this area (compare FIG. 3*a*, 3*b*), so that it works against the loss of power due to cooling of the arm musculature. Further, in the construction with short arms 22 the back part 1*a* is connected with the front parts 1*b* or the back part 1*a* crosses over into the front parts 1*b* (see descriptions for FIG. 4), the life jacket 1 is closed at the sides. This keeps cold water away from the body and the loss of heat will be reduced.

In the figures you can see examples of an inflatable life jacket 1. The provided type has the advantage, that the gas layer presses the life jacket 1 in an emergency situation towards the body, what provides a sealing effect. The water circulation around the body will be reduced and therefore as well the loss of heat. Further down in text, additional advantageous sealing measures will be described. Of course solid matter life jackets can be equipped with a heat producing layer too. Therefore measures for sealing are necessary to keep water away from the body.

For the activation of the exothermic reaction in the latent-heat storage material layer 16, an activation unit is provided. Here an automatic activation unit 20 is realized. It is designed and arranged in that way, that during inflation of the life jacket 1 in an emergency situation, it will be executed automatically and thus will start the exothermic process. Therefore exemplarily a small metal plate or the like is provided in the area of the latent-heat storage material layer 16, which receives a movement during inflation of the life jacket (it will be i.e. buckled or stretched), whereby seed crystals will be released. For example the movement can be initiated, in that an appendage of an inflation layer 18 reaches into the heat-producing layer 16. If the inflation layer 18 of the vest 1 inflates during the inflation process, the appendage also is widening, so that a previous buckled metal plate receives a stretching.

The arrangement of the automatic activation unit 20 is selected as an example in this embodiment. It can also be located at another functional area. Other activation mechanisms are possible. It is further possible, that an activation unit for the heat producing layer 16 is allocated to a separate sensor, which monitors, if an emergency situation is existent. This would also be necessary, if the life jacket 1 was a solid matter life jacket.

It is of advantage, if the life jacket 1 provides a manual activation unit 21 (i.e. a corresponding small metal plate or similar) for the latent-heat storage material, which ranges to a reachable user area at the exterior of the life jacket 1. This can be provided additionally to an automatic activation unit 20. In this way, the storage material can be activated by the carrier of the life vest 1, i.e. in the case that an automatic activation failed. The manual activation unit 21 can preferably be located, as shown exemplarily in FIG. 1, in the area of an advantageously pre-considered mouthpiece 14 for additionally inflating the life jacket 1.

After an emergency situation with carried out activation of the latent-heat storage material it is necessary, to fluidize the latent-heat storage material again, i.e. in a water bath. Therefore the life jacket needs eventually to be disassembled at least partially.

To reduce the water circulation between body and environmental water and therewith to reduce the loss of body temperature and the loss of generated heat from the latent-heat storage material 16, an advantageous embodiment of the life jacket 1 provides several advantageous waterproofing measures, which can be realized individually or preferably in combination at the life vest 1: At (see FIG. 4) the lower border area of the short arms 22, tight fitting and/or adjustable arm cuffs 23, wristbands or similar can be provided (i.e. made of Neoprene). The effect of the arm cuffs 23 can be improved, in that the short arms 22 in the area of the arm cuffs 23 have at least one arm air chamber in each case. In the described design three arm air chambers 23*a* are realized exemplarily per short arm 22. The arm air chambers 23*a* are advantageously connected to the inflatable layer 18 of the life vest 1 via channels or the like and are arranged and designed in such a manner, that during the inflation of the life jacket 1 the arm air chambers 23*a* will produce a pressure acting on the arm cuffs 23. Therefore the arm air chambers 24*a* are designed to be circular here. Further it can be of an advantage, to provide a water repellent tight fitting and/or adjustable pelvis cuff 8 at the lower border areas of the front parts 1*b* and of the back part 1*a*. It is an advantage if the neck area of the life jacket contains a fitting polo neck or neck cuff 3 etc. Further it is an advantage for the waterproofing of the life jacket 1, if its front parts 1*b* are connectable to one another via a waterproof or water repellent fastener 5 in vertical direction (zip lock, hook-and-loop fastener or similar). In FIG. 1 is it betoken exemplarily, that both front parts 1*b* in the shown design in the middle area and at the pelvis cuff 8 are connectable via a zip lock 5*a*, where at the neck cuff 3 a hook-and-loop fastener 5*b* is provided. Additionally horizontal locking bands 6 (i.e. one located short under the set-in of sleeve bight and one located in the belly area of the vest) can be provided.

FIGS. 3*a* and 3*b* show the heat-producing layer 16 of an advantageous embodiment of the invention. It can be seen, that the latent-heat storage material containing layer 16 in the back part 1*a* and in the front parts 1*b*, each is divided into a plurality of chambers 24, whereby a better, directed distribution of the material is reached. The exact amount, dimensions and arrangement of the chambers 24 depend on many factors, i.e. the size of the vest, its application. It is desirable, if in all vest sizes about the same amount of heating energy will be released, advantageously 60 to 70 degrees Celsius over at least 5 to 7 hours.

In the described advantageous design, the chambers 24 in the areas of the front parts 1*b* and the back part 1*a* are exemplarily rib-shaped and have approximately the width of a human middle finger, and are arranged across or diagonal to the body. The single chambers, ribs or similar are directly connected with each other or are interconnected via expediently arranged connection channels 24*a*, so that the heat producing process can spread into all desired areas after activation of the latent-heat storage material.

In FIG. 3*a* three rib shaped chambers 24 are accented, which are interconnected to one another by means of a plurality of small connection channels 24*a*. When dimensioning and arranging the connection channels 24*a*, it has to be taken care, that on the one hand their width is so appropriate, that they can forward the heating process. On the other hand, they should not be too wide because otherwise they support that the carrier of the life jacket, after solidification of the latent-heat storage material, does not have an adequate freedom of movement.

In FIGS. 3*a* and 3*b* it can be seen, that in this advantageous design, the chambers, ribs or similar extend over the shoulder area and the upper arm area. Of course the design, dimension and arrangement of the chambers could be realized in another way, i.e. labyrinth-shape, meander-shape, net-shape or also cell-shaped with distance of to each other arranged hollow spaces, which are interconnected by channels with each other. All together the design and dimensioning of the chambers, ribs, channels etc. of the heat producing layer 16 is to be selected in this way, that after the heat-producing process has finished and solidification of the latent-heat storage material has taken place, the desired freedom of movement of the vest carrier can be maintained.

In the shown advantageous embodiment, the heat-producing layer 16 is realized in this way that the chambers between back part 1*a* and front parts 1*b* are continuously in design. This can also be of an advantage in other designs of the partition of the heat producing layer 16. In the side-view in FIG. 4 it can be seen, that the back part 1*a* and the front parts 1*b* are connected sutureless here. Of course vest cuts are possible, where back part 1*a* and front parts 1*b* and their inner located layers are connected with each other by a stitching.

FIG. 5 shows schematically the multilayer construction of an embodiment of the life jacket 1: a) outer layer 17 made of a robust vest material, which can advantageously be provided in direction to the interior part of the life jacket with an isolation layer, which keeps the cold from the outside to the inside, out, b) gas (i.e. carbon dioxide) fillable layer 18 (inflation layer), caring for the major part of the buoyancy of an inflatable life jacket and similarly has an isolation function against thermal loss in direction to the exterior, c) heat-producing layer 16 with latent-heat storage material, d) Neoprene layer 19, which is used as a heat storage of the heat produced in heating layer 16; it releases dosed heat towards the body, so that burnings due to direct skin contact or thin cloths of the carrier can be avoided. Not all of the named layers 16, 17, 18, 19 must extend over all life jacket areas.

In FIGS. 1 to 4 other advantageous and appropriate configurations are explained besides the already described ones, which further improve the life jacket 1.

In the case of an inflatable life jacket 1, it provides an activator 10 which reacts based on water contact (i.e. salt-tablet-activator), which activates a propellant gas cartridge for the automatic inflation of the inflation layer 18 or the air chambers of the life jacket 1. Via the inflation layer 18, here an additionally provided air cushions 7 in the pelvis area and the arm air chambers 23*a* will be inflated via existing connection channels. Additionally to the automatic activator 10, a manual useable activator can be of an advantage.

A RFID (Radio Frequency Identification)-Transponder 15 can be integrated for example into the outer layer 17 of the life jacket 1 or can be attached to the outer layer 17, i.e. in the shoulder area. In cooperation with an corresponding reader a faster discovery of the vest 1 (i.e. in a warehouse) and a unique assignment of the respective owner, user, will thus be possible. Further service- and maintenance information etc. can be stored on the RFID-Transponder.

Further it can be advantageously, to provide a transmitter unit 13 in i.e. the shoulder area, which can send on a specific emergency frequency (i.e. international marine emergency frequency (406 MHz) or the emergency frequency of the aviation (121.5 MHz). The omnidirectional sending direction finder will be supplied through an energy source 12 (battery, accumulator etc.) integrated in the vest and eventually by a control module 12*a*. By this means the locating of a person in an emergency situation will be improved.

To better locate a person in emergency, a signal lamp 4 can be provided at the shoulder area of life jacket 1, which is activated automatically or manually in an emergency situation.

In the neck area of the life jacket 1, a special rest 2 (blackout protection) can be provided, which recovers a human from every position in water into a dorsal position and keeps his head over the water surface.

Further, at the head area (i.e. at the polo neck of the life jacket) a kind of cap 25 (froth protection) can be realized, which can be opened to cover the head in an emergency situation (i.e. in storms, high waves), to protect against froth and spraying water of the wave crest.

At the neck area of the life jacket 1 practically a mouth piece 14 can be provided, which can be used to inflate the life jacket 1 with the mouth in the case of a failure of the automatic inflation system.

A further improvement is a shark protection device 9, which includes two electrodes 9*a*, 9*b* at opposite ends of the life jacket 1 (i.e. one electrode 9*a* at the neck area of vest 1 and one electrode 9*b* at the lower pelvis cuff 8), which produce an electromagnetic field (dipole-system). The dipole radius and therefore the protection against sharks and other predators can be increased by pulling an electrode 9*b* by the means of withdrawing a pull cord 9*c* out of the life vest's body and by providing a weight which pulls the pull cord 9*c* in direction to the ground and tauten it. By the means of an impulse generator the device 9 builds an electromagnetic field around the castaway, which disturbs the Lorenzini ampules of sharks and other predators, so that they try to escape.

RFID-Transponder 15, transmitter unit 13, signal lamp 4, shark protection device 9, and eventually additional existing units will be controlled by the control module 12*a* (especially activated with the occurrence of an emergency situation) and will be supplied by an energy source 12 or a plurality of energy sources with electric power. In the shown embodiment the energy source 12 will be activated automatically when getting water contact by the means of a starter unit 11.

LEGEND

1 Life jacket (abbreviated: vest)
1*a* Back part
1*b* Front part
2 Rest
3 Neck cuff
4 Signal lamp
5 Fastener
5*a* Zip lock
5*b* Hook-and-loop fastener
6 Locking belt
7 Cushion in pelvis area
8 Pelvis cuff
9 Shark protection device
9*a* Electrode of 9
9*b* Electrode of 9
9*c* Pull cord
10 Automatic life jacket activator
11 Starter unit
12 Energy source
12*a* Control module
13 Transmitter unit
14 Mouth piece
15 RFID-Transponder
16 Heat-producing layer
17 Outer layer
18 Inflatable layer
19 Inner layer, Neoprene layer
20 Automatic activation unit for 16
21 Manual activation unit for 16
22 Short arm
23 Arm cuff
23*a* Arm air chamber
24 Chambers
24*a* Connection channel
25 Cap

The invention claimed is:

1. A life jacket for aquatic use comprising:

a back part;

a plurality of front parts connectable to one another with a fastener;

a trunk configured to cover a trunk area;

a pair of arms configured to cover the shoulders and extend into an upper arm area;

a plurality of layers, wherein said plurality of layers comprises a heating layer located at or near an inner side of the life jacket and said heating layer comprises a latent-heat storage material; and an activation unit for activating an exothermic reaction of said latent-heat storage material;

wherein said heating layer is subdivided into a plurality of rib-shaped chambers disposed in said back part and said front part, said plurality of rib-shaped chambers being connected directly with each other or connected to one another via connecting channels, said plurality of rib-shaped chambers being arranged diagonal to the body or across the body; and said plurality of rib-shaped chambers comprises a first plurality of rib-shaped chambers disposed on said trunk and a second plurality of rib-shaped chambers disposed on said arms.

2. The life jacket according to claim 1, wherein tight fitting and/or adjustable arm cuffs or wristbands are provided at a lower border area of the arms.

3. The life jacket according to claim 2, wherein at each arm in an area of the arm cuff at least one arm air chamber is provided, which is arranged and designed in that way, that during inflation of the life jacket a contact pressure acting on the respective arm cuff is generated in the at least one arm air chamber.

4. The life jacket according to claim 1, further comprising a fitting polo neck or a fitting neck cuff at a neck area.

5. The life jacket according to claim 1, further comprising a water-repellent tight fitting and/or adjustable pelvis cuff at respective lower border areas of the front parts and the back part.

6. The life jacket according to claim 1, wherein the front parts are vertically connectable with each other by the means of a waterproof or water-repellent fastener.

7. The life jacket according to claim 1, further comprising an automatic activation unit for the latent-heat storage material, which is activated automatically during inflation of the life jacket.

8. The life jacket according to claim 7, wherein the activation unit is a small metal plate, which is located in an area of the latent-heat storage material and gets a movement during inflation of the life jacket.

9. The life jacket according to claim 1, further comprising a manual activation unit for the latent-heat storage material, which is located in a reachable outer area of the life jacket.

10. The life jacket according to claim 1, wherein an inner layer of the life jacket is made of Neoprene.

11. The life jacket according to claim 1, wherein a RFID (Radio Frequency Identification)-Transponder is integrated in an outer layer of the life jacket or is attached to the outer layer.

12. The life jacket according to claim 1, further comprising a shark protection device, which includes two electrodes at opposite borders of the life jacket, which produce an electromagnetic field.

13. The life jacket according to claim 12, wherein an electrode can be withdrawn out of the life jacket by means of a pull cord, and a weight is attached to the pull cord.

14. The life jacket according to claim 1, further comprising a transmitter unit, which sends signals on a certain emergency frequency.

15. The life jacket according to claim 1, wherein the life jacket is an inflatable life jacket.

* * * * *